United States Patent [19]

Barbson

[11] 4,053,762

[45] Oct. 11, 1977

[54] TWIN-BEAM LUMINAIRE LENS

[75] Inventor: Grafton K. Barbson, Quarryville, Pa.

[73] Assignee: Armstrong Cork Company, Lancaster, Pa.

[21] Appl. No.: 644,753

[22] Filed: Dec. 29, 1975

[51] Int. Cl.[2] ..... F21V 5/00

[52] U.S. Cl. ..... 362/223; 362/339

[58] Field of Search ..... 240/106 R, 106.1, 93, 240/51.11 R

[56] References Cited

U.S. PATENT DOCUMENTS

| | | | |
|---|---|---|---|
| 3,009,054 | 11/1961 | Thomas | 240/51.11 R |
| 3,251,987 | 5/1966 | Wince | 240/106 R |
| 3,483,366 | 12/1969 | Wince | 240/106 R |
| 3,829,680 | 8/1974 | Jones | 240/106 R |

*Primary Examiner*—R. L. Moses

[57] ABSTRACT

A luminaire lens is provided with a prism arrangement which emits light in two beams. A two-light tube fixture is utilized with approximately the same amount of light coming from the 0° to 30° zone of candlepower distribution and the 30° to 60° zone of candlepower distribution, with very little light emitted from the 60° to 90° zone of candlepower distribution.

4 Claims, 3 Drawing Figures

TWIN-BEAM LUMINAIRE LENS

BACKGROUND OF THE INVENTION

1. Field of the Invention

The invention is directed to illumination and, more particularly, to a lens structure for distributing light from a two-tube light fixture in a certain predetermined pattern.

2. Description of the Prior Art

U.S. Pat. No. 3,647,148 is directed to a patent for a luminaire lens that distributes light in a very definite two beam pattern arrangement as seen in FIG. 7 of that patent.

U.S. Pat. No. 2,394,992 is directed to another luminaire lens in which light is directed in a very definite two beam pattern arrangement (see FIG. 3).

In the prior art, there are many different ways of distributing light from a light fixture. The above-mentioned U.S. patents distribute light in a very definite two beam pattern configuration with very little light distributed in the 0° to 30° zone of candlepower distribution and the 60° to 90° zone of candlepower distribution.

SUMMARY OF THE INVENTION

A luminare lens is used with a twin beam type of candlepower distribution to provide greater effective illumination. The lens has a large amount of light emitting from angles other than nadir. Most of the light rays are emitted at angles ranging from 20° from nadir to 45° from nadir. Due to the prism shape and arrangement in the bottom of the luminaire lens and the two sides of the luminaire lens, the candlepower distribution is such that the amount of light coming from the 0° to 30° zone of candlepower distribution is about equal to the light coming from the 30° to 60° zone and there is little light emitted from the 60° to 90° zone. The luminaire lens is used with a two-lamp fixture and provides increased effective illumination with a reduction in illumination in the nadir direction and in generally horizontal angles from the light fixture.

DESCRIPTION OF THE PREFERRED EMBODIMENT

Figure 1:
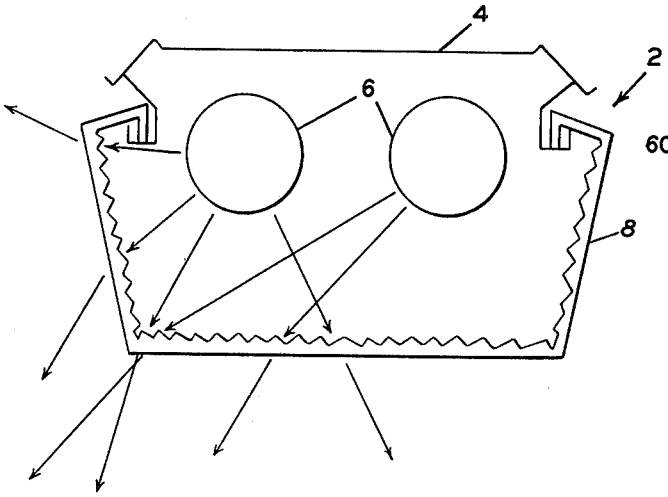
FIG. 1 is a cross section of a luminaire having the preferred tube and lens arrangement.

The structure of the luminaire having the inventive lens herein is shown in FIG. 1. A normal luminaire will cast light straight down and in such a manner that the greatest candlepower is distributed over the surface below the luminaire. This, of course, means that inasmuch as the shortest distance from the luminaire to the work is along the nadir, the vertical line from the center of the luminaire, the largest amount of light is concentrated directly below the light and spreads as widely as possible from the nadir to cover the maximum area most sufficiently.

Recently, luminaires have been developed, such as that in U.S. Pat. No. 3,647,148, wherein virtually no light is distributed in the direction of the nadir and the concentration of light is emitted at lateral angles on either side of the nadir. That patent substantially eliminates light rays from the 0° to 30° angular range from the nadir and directs substantially all the light rays within the angular range of 30° to approximately 60° on either side of the nadir.

The lens of FIG. 1 differs from both prior art distributions by providing a candlepower distribution such as that shown in FIG. 3, to be discussed below. The light fixture or luminaire 2 is composed of a housing 4 which contains two fluorescent tubes 6. A three-sided lens 8 is placed over the two tubes of the light fixture. The inside of the lens has a prism arrangement which will refract light to form the candlepower distribution curve of FIG. 3. The lens may be made of the conventional glass or plastic materials used in the art.

Figure 3:
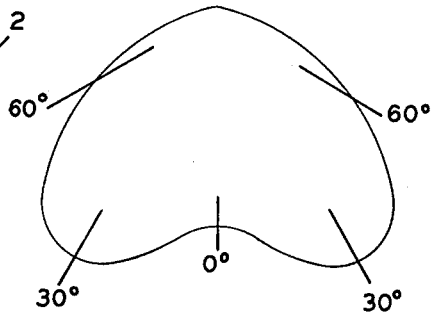
FIG. 3 is a light distribution diagram illustrating the transverse distribution of light from the luminaire shown in FIG. 2.
Figure 2:
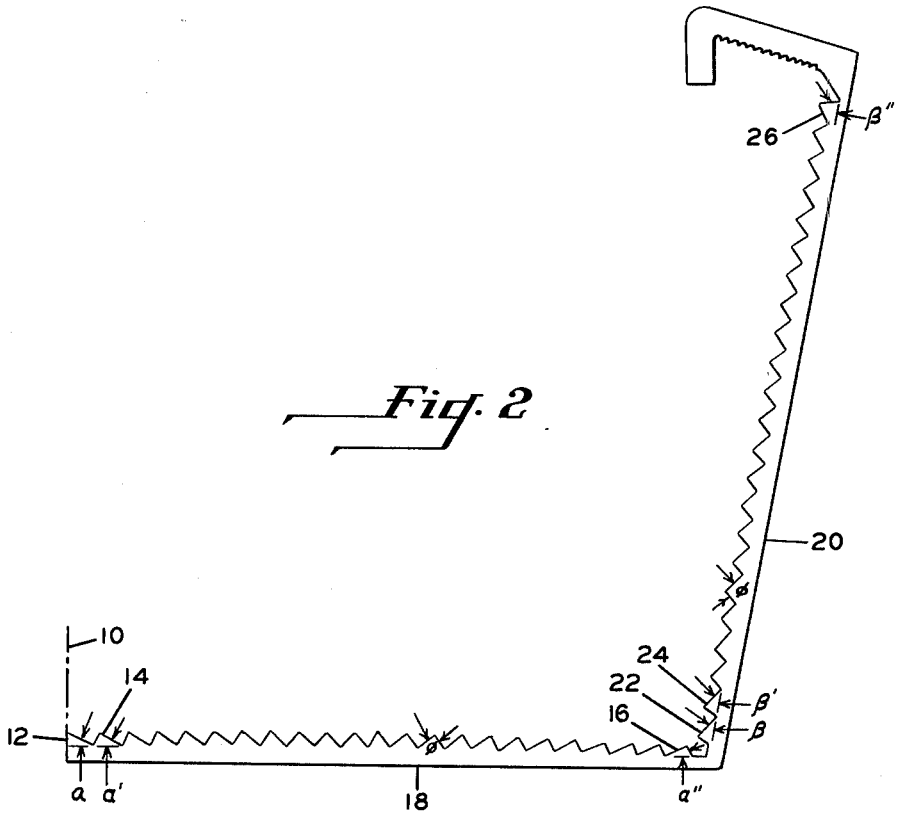
FIG. 2 is an enlarged cross-sectional view of a portion of the lens structure.

Referring now to FIG. 2, there is shown the prism arrangement on the bottom and sides of the lens 8 which yields the desired candlepower distribution curve of FIG. 3. Line 10 represents the center line of the lens, or the nadir line. The lens prisms are made approximately ⅛ inch wide and the alpha angle of the first prism 12 is a 30° included angle. The next adjacent prism 14 has a width or base of approximately ⅛ inch and its alpha prime angle is 32°. The prisms, as they extend across the lens bottom 18 from the center to the edge thereof, increase their alpha angles by two degrees with each prime until the last prism 16 is reached. At this time, the alpha double prime angle is 74°. This showing in FIG. 2 represents one half of the bottom 18 of the lens. The same type of distribution is provided on the opposite side of the lens with the alpha angles of the prisms therein all facing towards the center of the lens and all increasing from 30° to 74° by 2° increments.

The lens also has two sides 20 which are inclined at an angle from a line perpendicular to the plane of the bottom 18 of the lens to provide an included angle of 100° between the bottom and side. Along the sides 20 there is arranged a series of prisms. The prisms have a width of ⅛ inch. The first prism 22 has a beta angle of 35°. The next prism 24 has a beta prime angle of 36°. The prisms, as they extend along the side of the lens from the bottom of the lens to the top of the lens, have the beta angles increase by one degree until the last prism 26 is reached wherein the beta double prime angle is 57°. The prisms are all made with an theta angle of 78°. The theta angle is the included angle at the peak of the prisms. This construction for the lens 8 will provide the candlepower distribution curve of FIG. 3.

The curve of FIG. 3 is a polar diagram illustrating the candlepower distribution, taken in a transverse direction, of a longitudinal luminaire provided with the lens of the present invention. It will be seen that there is some distribution of light in the nadir direction which is directly perpendicular from the face of the lower plane of the luminaire. It will be seen that maximum light distribution is to either side of the nadir in the region of an angle from 20° to 45° from the nadir. Approximately 44% of the illumination on one side of the nadir appears in the area from 0° to 30° from the nadir. Another 46% of the illumination appears in the area from 30° to 60° from the nadir. Only approximately 9% of the illumination appears in the area from 60° to 90° from the nadir.

What is claimed is

1. An elongated luminaire for illuminating an area therebelow comprising a linear light source of two tubes and an elongated lens having a bottom section and two side sections on either side of the bottom section, said side sections being inclined at an angle from a line perpendicular to the plane of the bottom section of the luminaire, said sections having prisms formed on the side thereof facing the light source, said prisms constituting light incident and light emergent surfaces for redirecting and emitting light rays from the light source generally away from the vertical plane through and parallel to the axis of said linear light source and into annular ranges on either side thereof with substantially half of the light distributed in an area from 0° to 30° on each side of the vertical plane, and substantially the other half of the light distributed in an area from 30° to 60° on each side of the vertical plane.

2. The elongated luminaire of claim 1 wherein light rays are distributed in two areas on either side of the vertical plane with substantially all of the light distributed in the two areas on either side of the vertical plane and being in an area about 20° to 45° from the vertical plane.

3. An elongated luminaire for illuminating an area therebelow comprising a linear light source of two tubes and an elongated lens having a bottom section, said bottom section of the luminaire is formed with a series of prisms extending from the center of the bottom section of the luminaire to the edge of the luminaire, with one of the included angles of the prism being fixed in size and another included angle of the prism increasing as one progresses from the centermost prism to the edgemost prism of the bottom section, said sections having prisms formed on the side thereof facing said light source, said prisms constituting light incident and light emergent surfaces for redirecting and emitting light rays from said light source generally away from a vertical plane through and parallel to the axis of the linear light source and into annular ranges on either side thereof with substantially half of the light distributed in an area from 0° to 30° on each side of the vertical plane, and substantially the other half of the light distributed in an area from 30° to 60° on each side of the vertical plane.

4. An elongated luminaire for illuminating an area therebelow comprising a linear light source of two tubes and an elongated lens having a bottom section and two side sections on either side of the bottom section, said bottom section of the luminaire is formed with a series of prisms extending from the center of the bottom section of the luminaire to the edge of the luminaire, with one of the included angles of the prism being fixed in size and another included angle of the prism increasing as one progresses from the centermost prism to the edgemost prism of the bottom section, said sides of the luminaire having a plurality of prisms which extend from adjacent the bottom section of the prism to adjacent the top of the lens side by the ceiling mounting the elongated luminaire and said prisms have a fixed size included angle and an included angle which increases in size as one moves from adjacent the bottom section of the lens to adjacent the top of the lens side, said sections having said prisms formed on the side thereof facing said light source, said prisms constituting light incident and light emergent surfaces for redirecting and emitting light rays from said light source generally away from a vertical plane through and parallel to the axis of the linear light source and into annular ranges on either side thereof with substantially half of the light distributed in an area from 0° to 30° on each side of the vertical plane, and substantially the other half of the light distributed in an area from 30° to 60° on each side of the vertical plane.

* * * * *